US008708158B2

(12) United States Patent
Erdmann

(10) Patent No.: US 8,708,158 B2
(45) Date of Patent: Apr. 29, 2014

(54) MATERIAL SEPARATOR

(76) Inventor: Michael Joseph Erdmann, Marquette, MI (US)

( * ) Notice: Subject to any disclaimer, the term of this patent is extended or adjusted under 35 U.S.C. 154(b) by 0 days.

(21) Appl. No.: 13/506,812

(22) Filed: May 18, 2012

(65) Prior Publication Data

US 2013/0306527 A1 Nov. 21, 2013

(51) Int. Cl.
*B07B 13/00* (2006.01)
*B07B 1/22* (2006.01)

(52) U.S. Cl.
USPC ..... 209/659; 209/682; 209/266; 209/244; 209/233

(58) Field of Classification Search
USPC ..... 209/659, 682, 233, 235, 244, 266
See application file for complete search history.

(56) References Cited

U.S. PATENT DOCUMENTS 669,205 A * 3/1901 Messler ..... 209/244
2,356,295 A * 8/1944 Yost ..... 209/682
4,194,970 A * 3/1980 Clem ..... 209/263
5,407,079 A * 4/1995 Rancourt ..... 209/23
6,786,335 B1 * 9/2004 Gropper et al. ..... 209/12.1

* cited by examiner

*Primary Examiner* — Luis A Gonzalez

(57) ABSTRACT

A material Separator with a hopper, a rigid helically shaped tubular pipe structure, an inlet port, a large particle outlet port and a small particle outlet port. The helically shaped tubular pipe structure connected to the underside of the hopper. The helical pipe structure has an internal false bottom. The false bottom is perforated so that particles that are larger than the perforations flow down the upper portion of the helical tubular pipe structure and material particles that are smaller than the perforations drop through the perforations and flow down the lower portion of the helical tubular pipe structure. The larger material particles exit the large particle outlet and the smaller material particles exit the small particle outlet. A preferred embodiment includes the helical tubular pipe structure is constructed of a plurality of curved pipe members, each having flanges at each end so that one the flanged curved pipe member can be bolted to the adjoining flanged curved pipe member.

5 Claims, 3 Drawing Sheets

MATERIAL SEPARATOR

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of particle separators and more specifically to a portable gravity fed material separator.

Material particle separating devices have been in use for hundreds of years. For example, in the panning for gold, the gold particles are separated from sand and small rocks by passing the gold and unwanted materials such as sand and small rocks over a perforated sheet or screen allowing sand and small rocks to pass through the perforations, but leaving the larger gold particles on top of the perforated plate.

Conventional material separating devices, such as vibrating inclined screen systems, are typically very large, immobile, consume significant energy to operate and are inefficient. These devices are too large and expensive for many common household uses for which material separation and de-dusting would be useful. Similarly, there are industrial settings necessarily located where large vibrating inclined screen systems are impracticable and where the ability to separate materials according to particle size would be useful. Vibrating inclined screen systems or rotary screens are too unwieldy or require too much energy for many settings in which de-dusting through particle size separation is desired.

Dust from some materials may be carcinogenic and reduction of fines and fugitive dust in machinery and industrial settings can address health concerns, increase efficiency and reduce clinkers. The present invention may be useful for reducing and eliminating fines and dust in a variety of equipment and industrial uses including but not limited to bentonite clay placement, the gravel industry, food-handling systems and wood pellet de-dusting. Use of the present invention may be beneficial for health reasons related to removal of particulate matter.

Numerous particle separating devices have been developed for various industries. Many of these require an external power source for facilitating the operation of a vibrating member or of other pushing or material moving assemblies.

Additionally, many material particle separators are formed in an open design where the contents that are being separated can be exposed to outside influences such as dust and debris.

In addition, many existing particle separators take up a large amount of space to do their work. Finally, many existing particle separators are complicated and expensive to manufacture and maintain.

BRIEF SUMMARY OF THE INVENTION

The primary object of the invention is to provide a material separator that allows small particles to be separated from larger particles.

Another object of the invention is to provide a material separator that has a small footprint and can be portable.

Another object of the invention is to provide a material separator that requires no external power.

A further object of the invention is to provide a material separator that is covered at all times.

Yet another object of the invention is to provide a material separator that is inexpensive to manufacture.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a material separator comprising: a hopper connected to a rigid helically shaped tubular pipe structure, an inlet port, a large particle outlet port, a small particle outlet port, said helically shaped tubular pipe structure having an internal false bottom, said false bottom being perforated, so that material particles that are larger than said perforations flow down the upper portion of said helical tubular pipe structure and material particles that are smaller than said perforations fall through said perforations and flow down the lower portion of said helical tubular pipe structure, said larger material particles exiting said large particle outlet, and said smaller material particles exiting said small particle outlet.

BRIEF DESCRIPTION OF THE DRAWINGS

The drawings constitute a part of this specification and include exemplary embodiments to the Invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
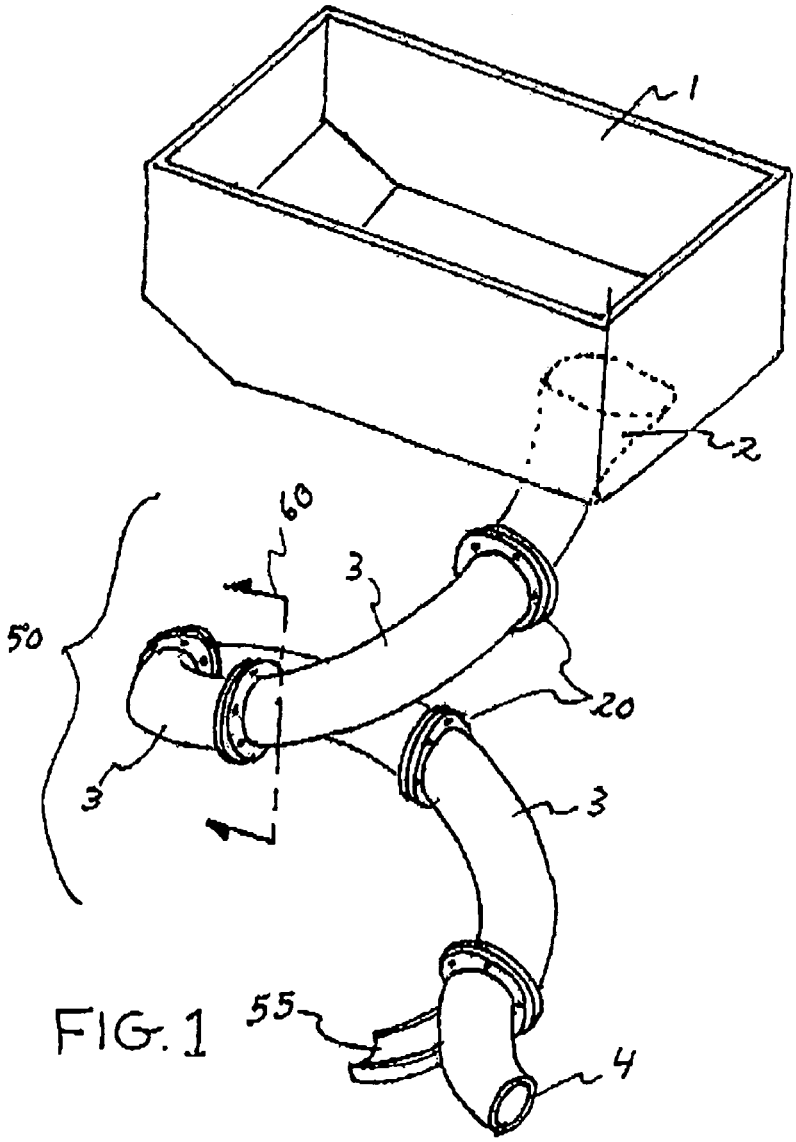
FIG. 1 is a perspective view of the invention.
Figure 2:
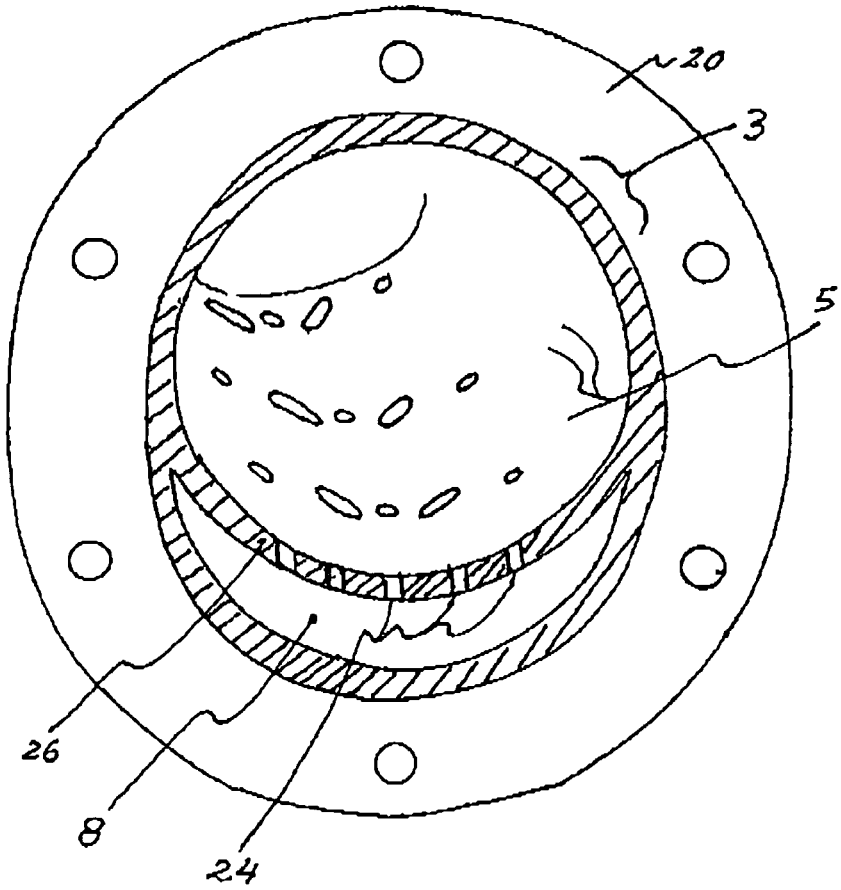
FIG. 2 is a section view of the tubular helical pipe of the present invention.

Referring now to FIG. 1 we see a perspective view of the invention. A hopper 1 and throat shown in dotted lines 2 connected to tubular helix 3 which terminates at large exit opening 4 and smaller exit opening 55. In the embodiment shown, the tubular helix 50 is comprised of a plurality of members 3 each having a flange 20 at each end so that the tubes 3 can be bolted or otherwise attached, by any standard means, to one another. The helical construction provides a gravity feed condition with a minimum footprint. The tubular structure also completely encloses the separator so that no extraneous materials can enter the separator of the present invention. The user fills the hopper 1 with material particles, and the particles proceed, by gravity, down the throat 2 and into the tubular structure 50. The material flows down the tube 50 in a minimum of 360 degree travel and, as it flows, the smaller particles of the material mix fall through apertures 24 in a false bottom 26 located inside the tube members 3 as shown in the section view in FIG. 2 as defined by section line 60 shown in FIG. 1. The smaller particles drop down into the lower channel 8 of the tube 3. The false bottom 26 and apertures 24 located at the bottom dead center of the tube assembly 3.

Still referring to the invention of FIG. 1, the proportion of the tubular helix 3 must be such that the amount of prolation is approximately equal to the diameter of the tubular helix 3. The height and diameter of the tubular helix 3 are variable and predicated upon the size, weight and structural characteristics of the materials to be separated. To separate wood pellets from fines, an approximate height of two feet and diameter of three inches would be required. Similar dimensions would be required for efficient bentonite placement in abandoned bore holes. The diameter of the spiral remains constant.

Still referring to FIG. 1, the construction details are that the invention may be made of plastic or steel with a level of smoothness, or C-value, inside the tubular helix 3 adequate to convey the materials to be separated. Construction materials must be flexible enough to enhance the vibrations created by the materials' movement through the tubular helix 3. The vibrational resonance assists the materials' movement and increases their ability to overcome deceleration utilizing inertial momentum. The various components may be made of a variety of materials including steel, plastic, aluminum or carbon reinforced resin.

Figure 3:
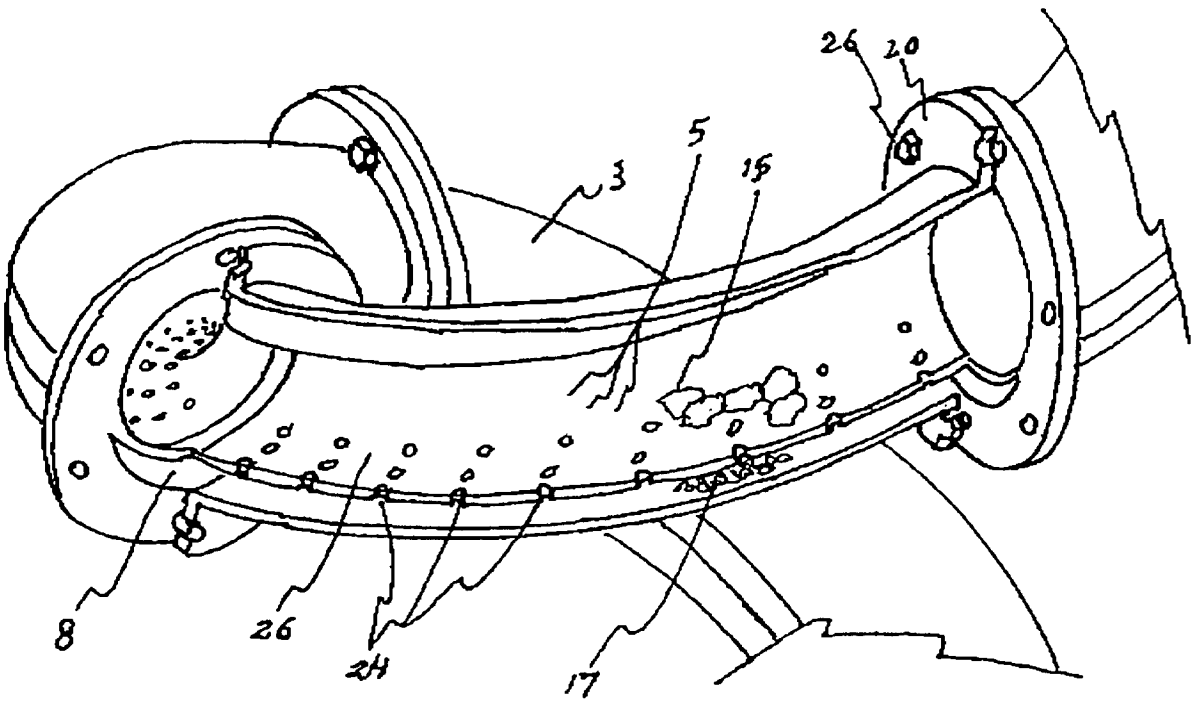
FIG. 3 is a cutaway perspective view of the helical pipe of the present invention.

FIG. 3 shows a cutaway perspective view of the invention. Larger material particles 15 remain in upper tube portion 5 while smaller material particles 17 drop through apertures 24 and fall down to lower channel 8. The gravity effect caused by the downwardly helical construction of the invention causes both large and small materials to travel to the end of the helical tube 50 and out large exit aperture 4 and small aperture 55 respectively. Tube sections 3 are held together by bolts 26 at flange members 20, or held together by other standard means such as welding, rivets or adhesive materials.

The advantages of the present invention include, without limitation, that it does not require an external power source, is highly portable and has a very high efficiency rate. The device's dimensions can be adjusted to accomplish a variety of material separation tasks. The device is also relatively easy and inexpensive to manufacture in comparison to current mechanically complicated powered separators.

In broad embodiment, the present invention is a gravity-powered material separating shrouded device that utilizes unique geometry, the three-dimensional tubular helix with a minimum of 360 degree of rotational travel, to efficiently separate particles based upon size, weight and structural characteristics. The separation results from the movement of materials over the perforation plating. Fine materials fall through the perforations, therefore separating finer and coarser particles. Fines are collected and could be re-used.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Material Separator comprising:

A hopper a rigid helically shaped tubular pipe structure;

an inlet port;

a large particle outlet port;

a small particle outlet port;

said helically shaped tubular pipe structure fixedly connected to the underside of said hopper;

said helically shaped tubular pipe structure having an internal false bottom;

said false bottom being perforated;

so that material particles that are larger than said perforations flow down the upper portion of said helical tubular pipe structure and material particles that are smaller than said perforations flow down the lower portion of said helical tubular pipe structure;

said larger material particles exiting said large particle outlet; and said smaller material particles exiting said small particle outlet.

2. Material Separator as claimed in claim 1 wherein said helical tubular pipe structure is constructed of a plurality of curved pipe members;

each said pipe member including flanges at each end so that one said flanged curved pipe member can be bolted to an adjoining said flanged curved pipe member.

3. Material Separator as claimed in claim 1 wherein said rigid helically shaped tubular pipe structure is made of steel.

4. Material Separator as claimed in claim 1 wherein said rigid helically shaped tubular pipe structure is made of plastic.

5. Material Separator as claimed in claim 1 wherein said small material particle outlet port is directly below said large material particle outlet port.

* * * * *